US005299679A

United States Patent [19]

Obara et al.

[11] Patent Number: 5,299,679

[45] Date of Patent: Apr. 5, 1994

[54] APPARATUS FOR PILING AND TRANSFERRING CIGARETTES

[75] Inventors: Koichiro Obara; Tadao Etani; Hiromitsu Ohara, all of Tokyo, Japan

[73] Assignee: Japan Tobacco Inc., Tokyo, Japan

[21] Appl. No.: 994,643

[22] Filed: Dec. 22, 1992

[30] Foreign Application Priority Data

Dec. 25, 1991 [JP] Japan ..... 3-356638
Dec. 25, 1991 [JP] Japan ..... 3-356642

[51] Int. Cl.[5] ..... B65G 57/00

[52] U.S. Cl. ..... 198/418.3; 131/282; 131/287; 53/149; 53/150; 53/151

[58] Field of Search ..... 198/418.3; 53/148-154; 131/282, 283, 287, 96

[56] References Cited

U.S. PATENT DOCUMENTS 952,256 3/1910 Jacobsen .
1,926,222 12/1953 Arelt .
3,412,520 11/1968 Schmermund .
3,603,445 9/1971 Zausch et al. ..... 53/149
3,739,545 6/1973 Lattke .
3,899,865 8/1975 Revaz .
4,095,396 6/1978 Seragnoli .
4,364,464 12/1982 Manservisi et al. ..... 53/150
4,559,757 12/1985 Focke et al. .
4,614,263 9/1986 Nagata et al. ..... 53/151
4,823,536 4/1989 Manservigi et al. .
4,848,060 7/1989 Kubis et al. .
4,947,617 8/1990 Focke et al. .
5,070,991 12/1991 Hinchcliffe et al. ..... 53/149
5,244,075 9/1993 Obara et al. ..... 198/418.3

FOREIGN PATENT DOCUMENTS 134590 3/1985 European Pat. Off. .
509293 10/1992 European Pat. Off. .
512493 11/1992 European Pat. Off. .
2191166 12/1987 United Kingdom .

*Primary Examiner*—Joseph E. Valenza

[57] ABSTRACT

A plurality of cigarette piling heads are provided on a cigarette piling drum. The same number of cigarettes as the number of cigarettes in a cigarette package are piled on each cigarette piling head. An intermediate drum includes the same number of cigarette holding heads as the number of the cigarette piling heads and is provided at an axial end of the cigarette piling drum. A pushing-out drum has the same number of pushers as the number of the cigarette piling heads and is disposed at the other axial end of the cigarette piling drum. The cigarettes on each cigarette piling head are transferred to the corresponding cigarette holding head. The intermediate drum is disposed adjacent to and at a side of the first drum of a packing apparatus. The cigarette holding heads swing synchronously with packing heads of the intermediate drum. The cigarette piling heads swing synchronously with the cigarette holding heads of the first drum.

3 Claims, 15 Drawing Sheets

APPARATUS FOR PILING AND TRANSFERRING CIGARETTES

BACKGROUND OF THE INVENTION

1. Field of the Invention

This invention relates to an apparatus for arranging and stacking cigarettes, which every time arranges cigarettes side by side to form a plurality cigarette layers each consisting of a predetermined number of cigarettes, for example, three cigarette layers consisting of the lower layer of seven cigarettes, the intermediate layer of six cigarettes and the upper layer of seven cigarettes; which each time piles the cigarette layers on one after another in a staggered manner to form a cigarette stack consisting of a predetermined cigarette layers, for example, a cigarette stack consisting of the above-mentioned three layers including twenty cigarettes in total; and which transfers the cigarette stack to a packing device.

2. Description of the Related Art

In a cigarette wrapping system, there has been used a cigarette piling apparatus which arranges, side by side, cigarettes to form a plurality of cigarette layers, the total number of cigarettes of the cigarette layers being equal to the number of cigarettes in a cigarette package, and which piles these cigarette layers on one after another to form a cigarette stack. For example, the apparatus arranges seven, six and seven cigarettes side by side as separate layers and piles them in a staggered manner to form a cigarette stack consisting of the three cigarette layers. The cigarette stack is transferred to a wrapping device to be packed.

There are several types of packing apparatuses. In the recent packing apparatus, a plurality of drums are radially arranged so as to be adjacent to each other, a plurality of heads for holding piled cigarettes are provided on each drum. The drums are rotated synchronously and cigarettes whose number corresponds to the number of cigarettes in a cigarette package are transferred as a cigarette stack to each head. While the cigarette stack is being transferred between the adjacent heads, a wrapping sheet is supplied between the heads and the cigarette stack is wrapped with the wrapping sheet. When the cigarette head is transferred to the following head of the drum, the wrapping sheet is folded. In this way, a series of wrapping processes are performed while the cigarette stack is transferred from the first head to the last head of the drum.

In the packing apparatus, the heads of the drum make a predetermined swing in order to facilitate the transfer of the cigarette stack. Specifically, the heads of a pair of adjacent drums swing so that they face each other as they approach each other. When the heads approach each other, the cigarette stack is transferred from one of the head to the other head.

Since the heads make complicated swing motion, the mechanism for transferring a cigarette stack between the heads is also complicated. Thus, it is difficult to unite the cigarette piling device with the packing device to form a wrapping apparatus of a unitary structure. Even if such wrapping apparatus were obtained, it is anticipated that it could be operated at a high speed.

The cigarette stacks each consisting of twenty cigarettes, for example, are not held and thus lose their shape very easily. This becomes a factor of hindering a high speed operation of the apparatus.

SUMMARY OF THE INVENTION

This invention is intended to provide an apparatus for piling and transferring cigarettes, which overcomes the drawbacks of the conventional apparatus and is operated at a high speed with high reliability.

An apparatus of this invention includes a cigarette piling drum provided at its outer peripheral portion with a plurality of cigarette piling heads. A predetermined number (for example, three) of cigarette layers (the number of the total cigarettes being also a predetermined number, for example, twenty) are piled on each head.

An intermediate drum is provided close to one axial end of the cigarette piling drum and coaxially therewith and is rotated synchronously with therewith. The same number of heads as that of the cigarette piling heads are provided on the intermediate drum.

A pushing-out drum is provided close to the other axial end of the cigarette piling drum and coaxially therewith and is rotated synchronously therewith. The pushing-out drum includes the same number of pushers as that of the cigarette piling heads The cigarette piling heads, the heads of the intermediate drum and the pushers synchronously move on a circle. Piled cigarettes are pushed out of the cigarette piling heads by the pushers and transferred to the heads of the intermediate drum.

The intermediate drum is disposed close to and at the side of one of the drums (the first drum) of a packing apparatus. The heads of the intermediate drum swing synchronously with the heads of the first drum of the packing apparatus so that cigarettes are transferred from the heads of the intermediate drum to the heads of the first drum of the packing apparatus.

The heads of the cigarette piling drum swing synchronously with the heads of the intermediate drum at least in a region in which the cigarettes are transferred from the cigarette piling heads to the heads of the intermediate drum. This swing action allows the cigarettes to transfer the cigarette piling heads to the heads of the intermediate drum smoothly. The apparatus of this invention operates in a simple way at a high speed with high reliability.

An apparatus according to a preferred embodiment of this invention is provided at its both sides with a pair of rotatable cigarette-side holding arms. When cigarettes are being transferred to the cigarette piling heads, these arms are rotated in directions in which they are separated from each other so that they do not hinder the piling operation of cigarettes on the cigarette piling heads. After the cigarette piling operation has been completed, the cigarette-side holding arms are rotated toward each other. The arms hold both sides of a cigarette stack and prevents it from losing its shape. This enables the apparatus to operate at a high speed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of this invention, which is a cigarette arranging and piling apparatus used in a continuously operated wrapping machine, will now be described with reference to the accompanying drawings.

Referring to FIGS. 1 to 4, the overall wrapping machine will be described.

Figure 1:
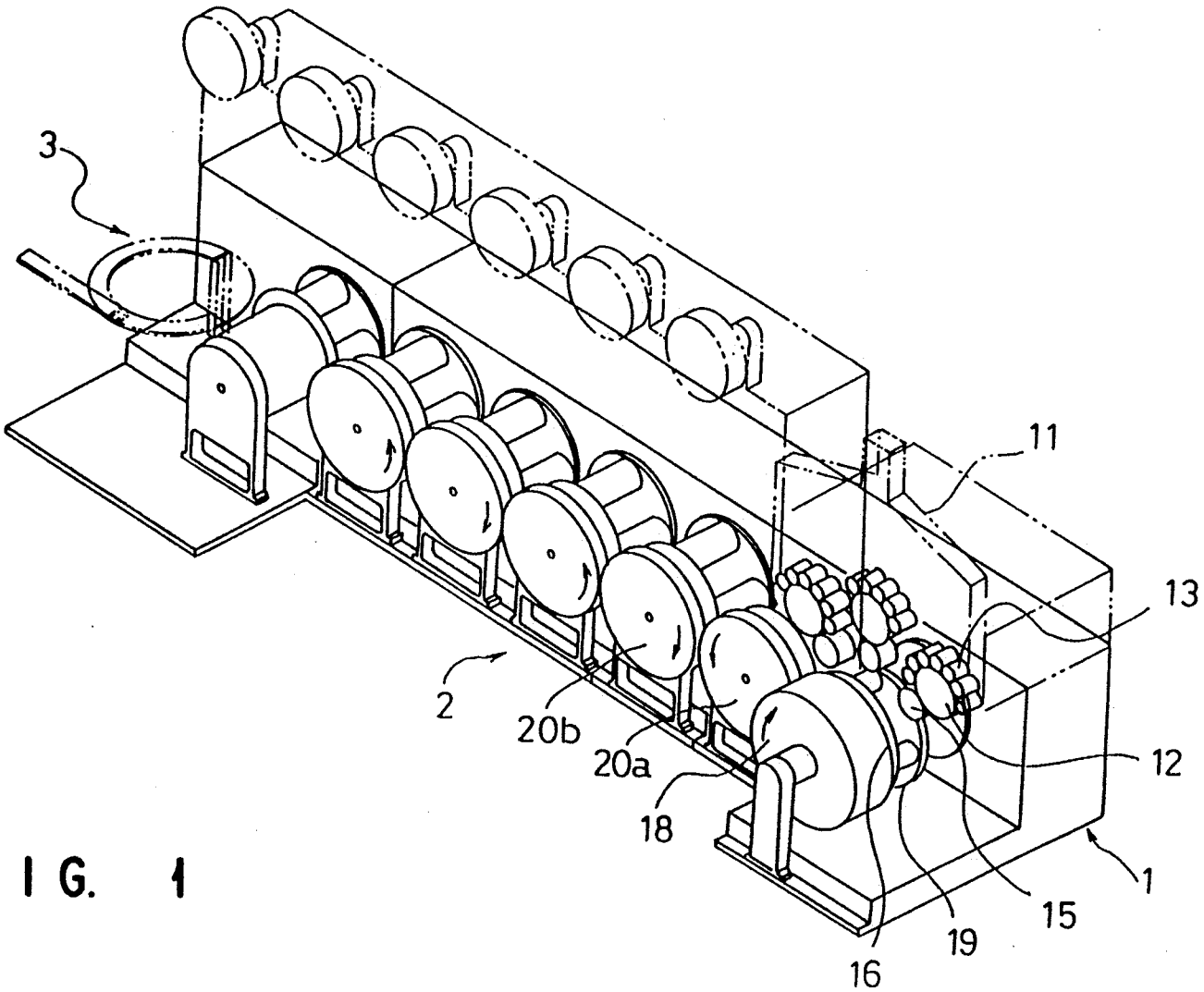
FIG. 1 is a perspective view of the overall wrapping machine according to one embodiment of this invention.

Shown in FIG. 1 is a cigarette piling apparatus 1 which arranges cigarettes placed in a hopper 11 side by side to form cigarette layers consisting of predetermined numbers of cigarettes, for example, a first cigarette layer consisting of seven cigarettes which will constitute the lower cigarette layer of a cigarette stack to be formed, a second cigarette layer of six cigarettes which will constitute the intermediate layer of the cigarette stack and a third cigarette layer consisting of seven cigarettes which will constitute the upper cigarette layer of the cigarette stack, and piles these cigarette layers on one after another in a staggered manner. The piled cigarettes whose number corresponds to the number of cigarettes in a package (twenty, for example) are delivered to a packing apparatus 2. Then the processes are repeated. In the packing apparatus 2, the piled cigarettes are moved between a plurality of drums and wrapped in wrapping sheets so as to be formed into a cigarette package. The thus formed package is delivered to a sealing apparatus 3 by which a seal or the like is applied to the package and sent to the following apparatus.

Figure 2:
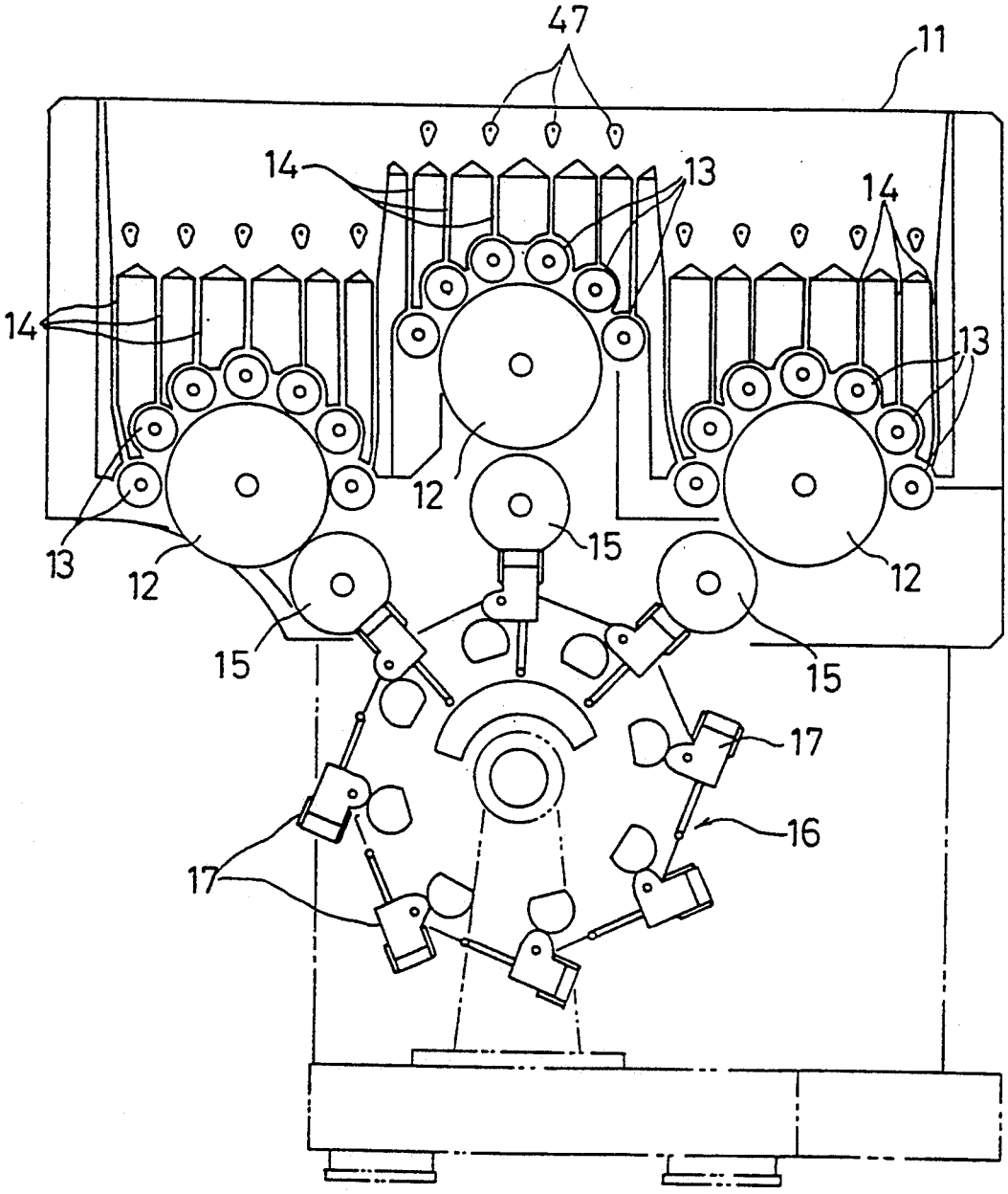
FIG. 2 is a perspective view of the overall cigarette piling apparatus according to the embodiment of this invention.

As shown in FIG. 2, the cigarette piling apparatus 1 is provided with cigarette arranging drums 12, cigarette receiving drums 13, transfer drums 15 and a cigarette piling drum 16. The cigarette arranging drums 12 are three in number and are disposed above the cigarette piling drum 16 so as to be arranged in the circumferential direction of the drum 16. A group of seven cigarette receiving drums 13, another group of six cigarette receiving drums 13 and a further group of cigarette receiving drums 13 are disposed above the corresponding cigarette arranging drums 12 so as to be arranged in the circumferential direction of the corresponding drums 15.

Cigarette supplying passages 14 are provided so as to be connected to the corresponding cigarette receiving drums 13. The cigarette supplying passages 14 is adapted to align cigarettes and supply them to the corresponding cigarette receiving drums 13 by the weight of the cigarettes. The upper end of each cigarette supplying passage 14 opens to the interior of the hopper 1.

The cigarettes aligned in the cigarette supplying passages 14 and supplied by their own weight to the cigarette receiving drums 13 are received by each cigarette receiving drum 13 one by one and transferred to the cigarette arranging drums 12. Accordingly, cigarettes on each cigarette receiving drum 13 are transferred one by one to the corresponding cigarette arranging drum 12.

Seven, six and seven cigarettes are supplied to the first to third groups of the cigarette arranging drums 12, respectively, and then the cigarettes are aligned and held on the cigarette arranging drums 12.

Next, the thus arranged cigarettes on the cigarette arranging drums 12 are supplied to the transfer drums 15. The transfer drums 15 are disposed between the cigarette arranging drums 12 and the cigarette piling drum 16 and transfer the cigarette layers transferred from the cigarette arranging drums 12, one by one, to the cigarette piling drum 16.

A plurality of cigarette piling heads 17 are provided on the outer circumference of the cigarette piling drum 16. Cigarette layers are supplied from the respective transfer drums 15 to the cigarette piling drum 16 and piled on the corresponding cigarette piling head 17 in a staggered manner to form a three-layered cigarette stack.

Figure 3:
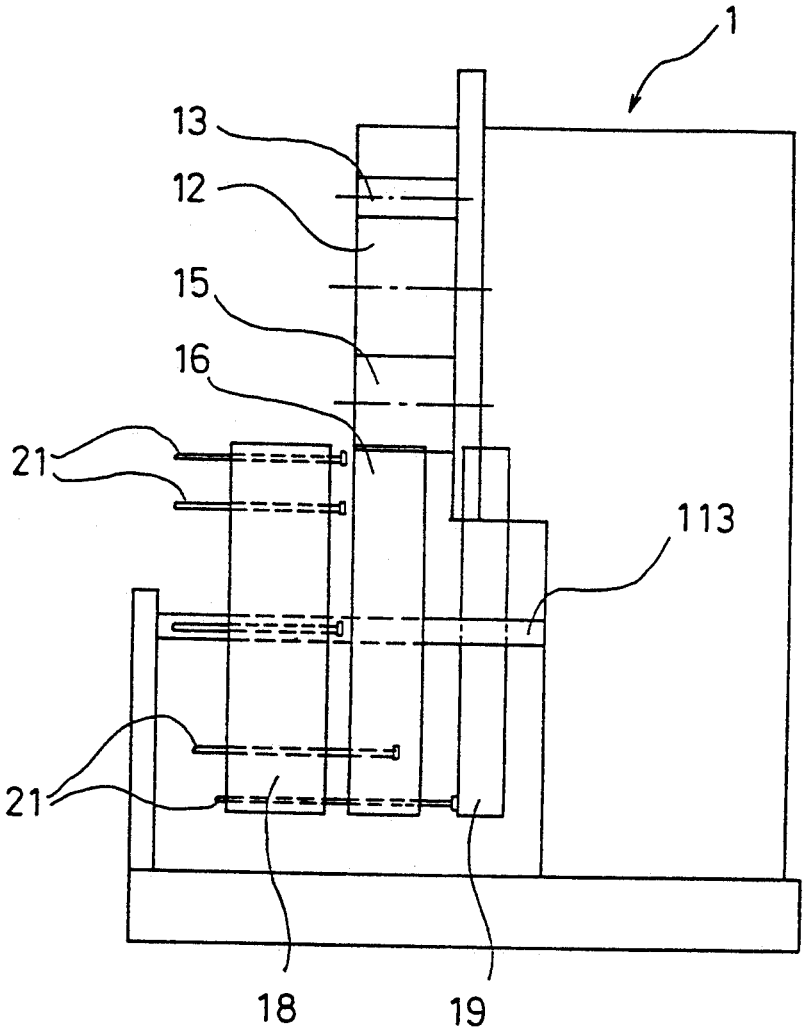
FIG. 3 is a general side view of the cigarette piling apparatus.
Figure 4:
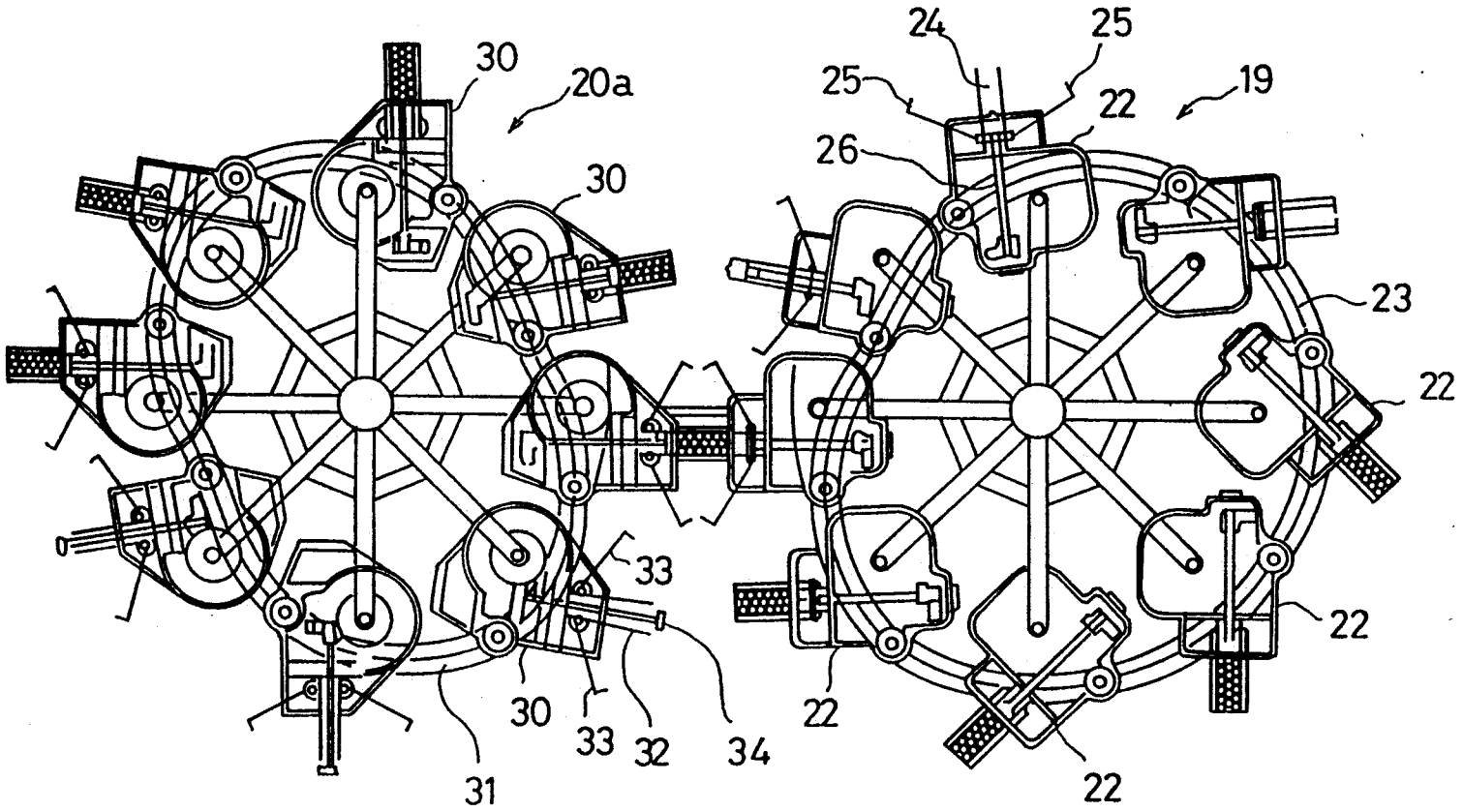
FIG. 4 is a general front view of an intermediate drum and a first drum.

As shown in FIG. 3, a pushing-out drum 18 is provided at one side of the cigarette piling drum 16 concentrically therewith, and the intermediate drum 19 is provided at the other side of the cigarette piling drum 16 concentrically therewith. Both drums 18 and 19 are rotated synchronously with the cigarette piling drum 16. The pushing-out drum 18 is provided with the same number of the cigarette piling heads 17 as the number of the cigarette piling heads 17. As shown in FIG. 4, the intermediate drum 10 is also provided with the same number of cigarette holding heads 22 as the number of the cigarette piling heads 17. The pushers of the pushing-out drum 18 are pushed out axially by means of a cam mechanism so as to push out the piled cigarettes held by the cigarette piling heads 17 of the cigarette piling drum 16 to the cigarette holding heads 2 of the intermediate drum 19.

Each head of the intermediate drum 19 has a holder 24 made from a thin-plate member. Twenty piled cigarettes corresponding to the number of cigarettes contained in a cigarette package to be formed are moved in the holder 24 and held therein. Openable fingers 25 are provided in the head 22. When the fingers 25 are closed, the cigarettes in the holder 24 is prevented from being thrown away due to a centrifugal force. The head 22 is provided with a pusher 26 which pushes out the cigarettes from the interior of the holder 24.

The intermediate drum 19 is disposed close to the first packing drum 20*a* of the packing apparatus 2. The first packing drum 20*a* has packing heads 30 which have the same structure as the cigarette holding heads 22 of the intermediate drum 19. Each head 30 is provided with a holder 32, fingers 33 and a pusher 34 functioning similarly to those of the intermediate drum 19. The heads 22 and 30 change their posture and swings on peripheral cams 23 and 31 in response to the rotation of the drums 19 and 20*a* so that the heads 22 and 30 are moved in a state in which the holders 24 and 32 are disposed in parallel with each other in the region where the heads 22 and 30 approaches each other.

As the heads 20 and 30 approach each other, the fingers 25 of the head 22 open and the holder 24 of the head 22 is inserted into the holder 32 of the head 30. By keeping this state, the pusher 26 of the head 22 advances and the pusher 34 of the head 30 recedes, whereby the piled cigarettes are moved into the holder 32 of the head 30. Thereafter the fingers 33 of the packing heads 30 are closed. This operation is performed at a predetermined timing by means of a cam mechanism (not shown). During the interval of transferring cigarettes from the head 22 to the head 30, a wrapping sheet is inserted between the heads 22 and 30 and the cigarette stack is wrapped with the wrapping sheet, whereby the first part of wrapping process is carried out.

The similar cigarette transfer is conducted between the first packing drum 20*a* and a second packing drum 20*b* disposed close thereto in the packing apparatus 2 and the second part of the wrapping process, for example, wrapping of the cigarettes, wrapped with the first mentioned wrapping sheet, with another wrapping sheet is also carried out during this cigarette transfer. The cigarette transfer and wrapping are performed similarly between the succeeding adjacent drums. The final wrapping process is carried out between the last two drums in the packing apparatus, and a complete cigarette package is formed. A seal or seals are applied to the cigarette package by the sealing apparatus 3 and transferred to the following apparatus.

Figure 5:
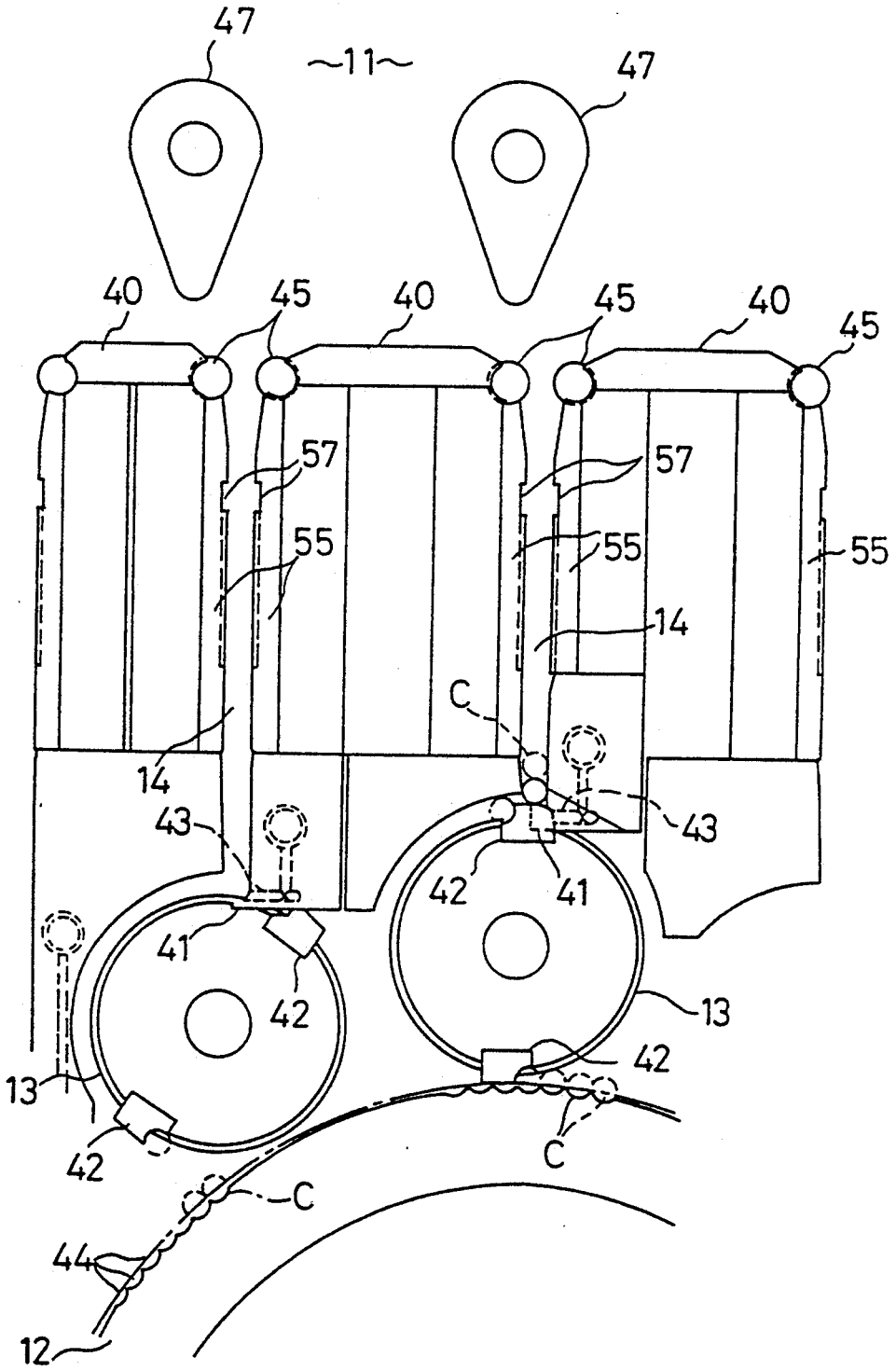
FIG. 5 is a front view of a hopper and part of a receiving drum.
Figure 6:
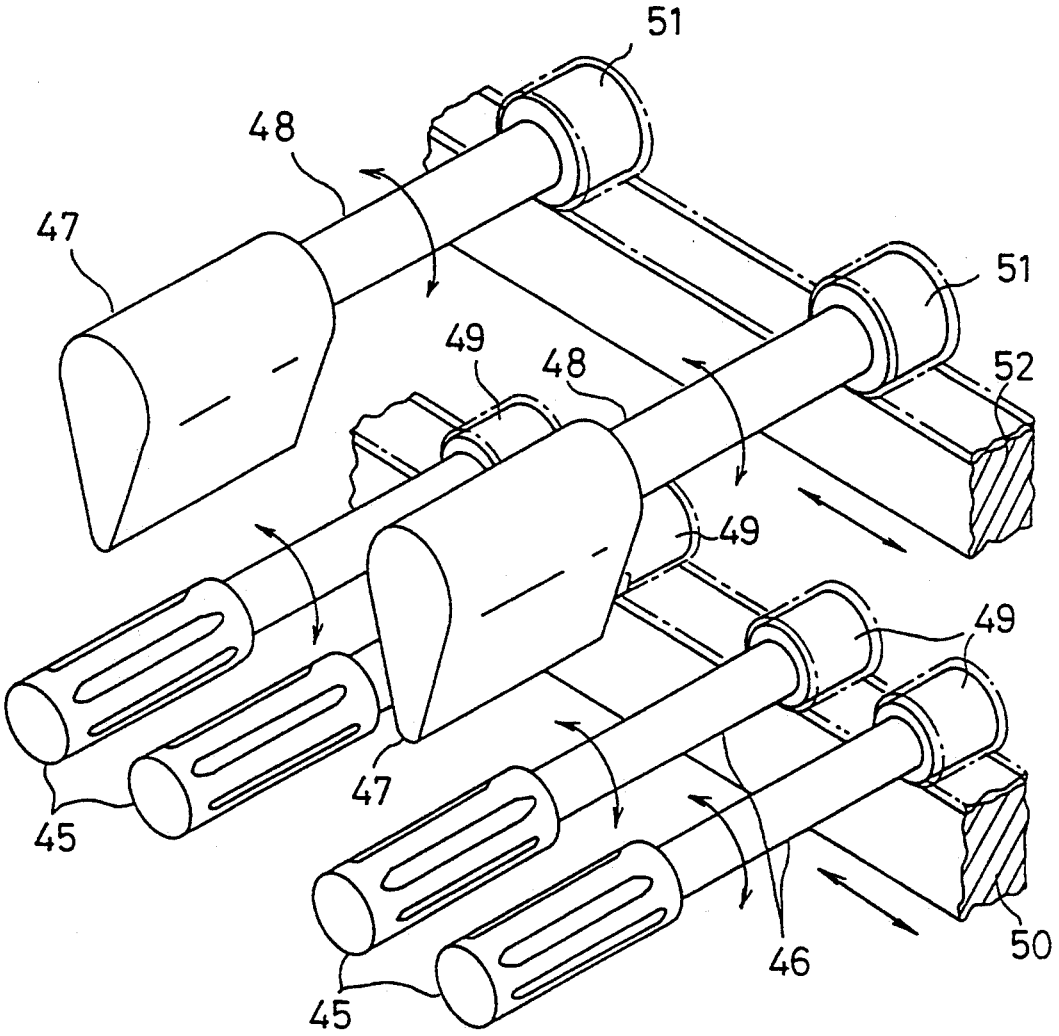
FIG. 6 is a perspective view of agitator rollers and agitator vanes.
Figure 7:
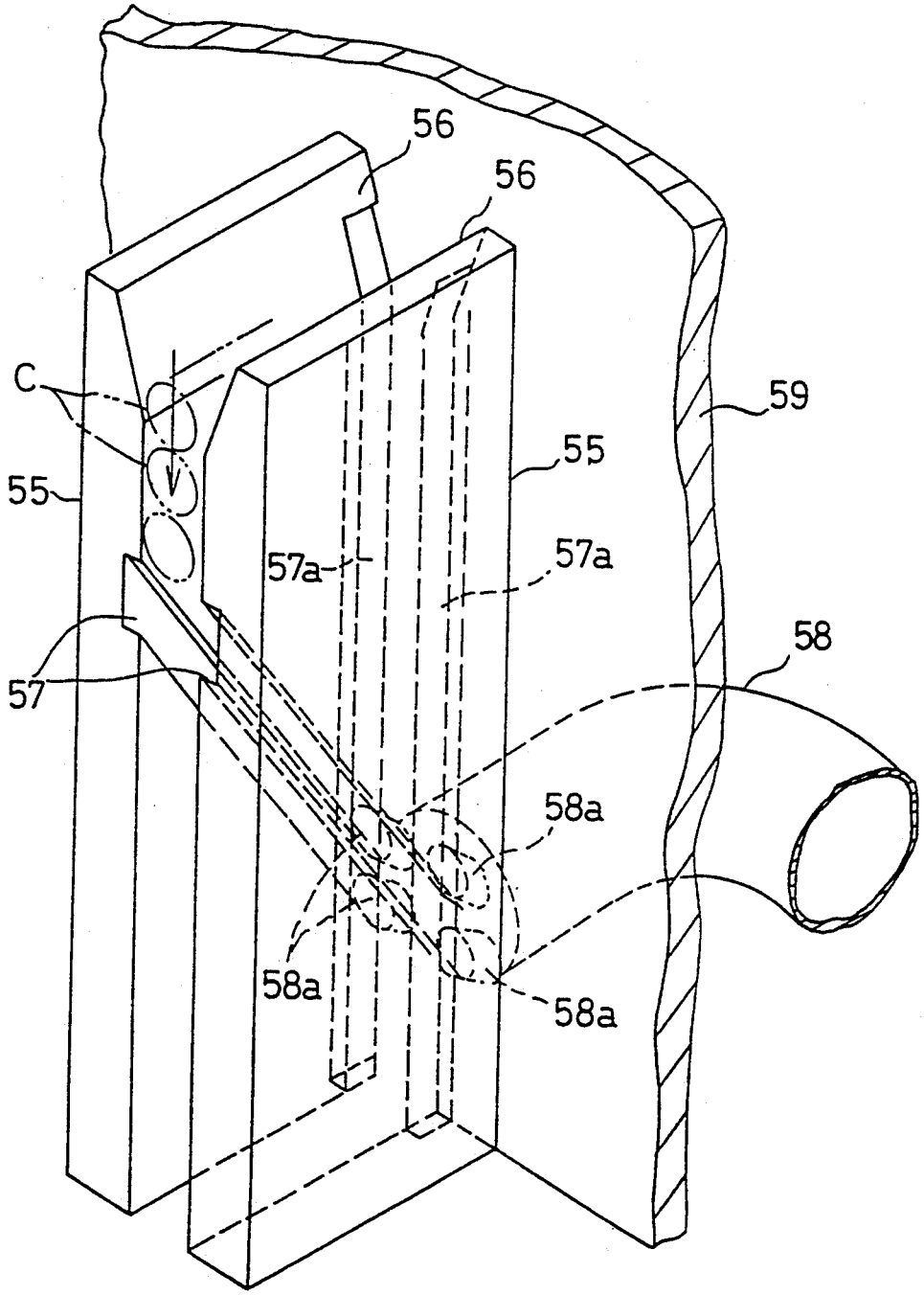
FIG. 7 is a perspective view of part of a cigarette supplying passage.

The structure of the hopper 11 and the cigarette receiving drums 13 will be described with reference to FIGS. 5 to 7. The cigarette receiving drums 13 and the cigarette supplying passages 14 corresponding thereto are shown in FIG. 5.

At the bottom portion of the hopper 11 are provided blocks 40 in which the cigarette supplying passages 14 are formed. At the lower end portion of each cigarette supplying passage 14 is formed a cigarette holding projection 41 which has a suction hole 43 connected to a negative-pressure mechanism (not shown). The cigarettes C supplied to the cigarette supplying passages 14 in an aligned state are sucked and held on the cigarette holding projections 41 by mean of the negative pressure.

From each cigarette receiving drum 13 project a plurality of cigarette receiving holders 4 (two in number, for example), each of which is provided with a suction hole (not shown) connected to a negative-pressure mechanism (not shown) so that the cigarettes C are sucked and held on the cigarette receiving holders 42. When each cigarette receiving holder 42 passes the lower end portion of the region of the corresponding cigarette supplying passage 14 as the cigarette receiving drum 13 rotates, each cigarette receiving holder 42 receives a single cigarette held on the corresponding cigarette holding projection 41.

In the outer peripheral surface of each cigarette drum 12 are formed seven or six parallel cigarette holding grooves 44, the number of which corresponds to the number of cigarettes in each cigarette layers to be arranged side by side. Each cigarette holding groove 44 has a suction hole for sucking and holding cigarettes C in the cigarette holding groove 44. Every time each cigarette arranging drum 12 passes the region of the corresponding cigarette receiving drum 13 as the cigarette arranging drum 12 rotates, the cigarettes C are transferred one by one from the cigarette receiving drum 13 to the cigarette holding groove 44 in such a way that seven or six cigarettes C whose number corresponds to the number of the cigarettes in each cigarette layer to be formed are held in the cigarette holding grooves 44 in a side-by-side arranged state.

A mechanism for transferring cigarettes C smoothly from the interior of the hopper 11 to the cigarette supplying passages 14 will be described. Because a great number of cigarettes are contained in the hopper 1, the cigarettes firmly contact together at the upper end portions of the cigarette supplying passages 14, and thus the inlets provided at the upper end portions of the cigarette supplying passages 14 are likely to be clogged with the cigarettes and causes a so-called bridge phenomenon, if no means is provided, when the cigarettes are introduced into the cigarette supplying passages 14. On both sides of each inlet are provided a pair of agitator rollers 45 for preventing the bridge phenomenon. Above the inlets are provided a plurality of agitator vanes 47 which have a generally streamlined shape for allowing smooth flow of cigarettes. As shown in FIG. 6, each agitator roller 45 is connected to a rotary shaft 46 and each agitator vane 47 is connected to another rotary shaft 48. The rotary shafts 45 and 48 extend rearward through the rear wall of the hopper 1. Pinions 49 and 51 are fixed to the rear end portions of the rotary shafts 46 and 48, respectively. Racks 50 and 52 mesh with the pinions 49 and 51, respectively. The racks 50 and 52 are swung alternately in the both directions shown by arrows in FIG. 6, and thus the agitator rollers 45 and agitator vanes 47 are swung alternately in the opposite rotational directions as shown in FIG. 6.

The rotation of the agitator rollers 45 in the opposite directions horizontally reciprocates the cigarettes in the vicinity of the inlets of the cigarette supplying passages 14 in order to prevent the vicinity of the inlets from clogging with the cigarettes. As the agitator vanes 46 swing, the cigarettes above the ones at the inlets are reciprocated largely in horizontal directions and such reciprocation prevents the inlets from being clogged with cigarettes, making the cigarettes flow smoothly. The synchronous reciprocal swing motions of the agitator vanes cause the overall cigarettes to move horizontally so as to avoid crushing or bending of cigarettes or disturbance of the flow of cigarettes.

The structure of the cigarette supplying passages 14 will be described. Each cigarette supplying passage 14 is formed in the corresponding block 40 as described above, and both side walls of the cigarette supplying passage 14 are formed by a pair of wall members 55 as shown in FIGS. 5 and 7. The upper end portion of the wall member 55 is formed with a tapered portion 56 in such a way that cigarettes C are smoothly introduced into the cigarette supplying passage 14.

In the inner surface of each wall member 55 is formed a shred ejecting groove 57 which extends slantwise downward, for example, from the front side to the rear side of the wall member 55. A shred ejecting passage 58 has its inlet end facing the lower end of the shred ejecting passage 58 and its outlet end connected to a suction mechanism (not shown).

More or less cigarette shreds fall off the cigarettes C contained in the hopper 11. The fallen shreds enter the cigarette supplying passages 14 and are sandwiched between the cigarettes C moving in the cigarette supplying passages 14 and the walls of the wall members 55. The shreds would sometimes obstruct the smooth movement of the cigarettes C. Further, they would sometimes arrive at the cigarette receiving drums 13 and the cigarette arranging drums 12 both disposed below and enter the spaces between the piled cigarettes.

The formation of the shred ejecting grooves 57 allows the shreds to drop into the shred ejecting grooves 57. The shreds fall in the shred ejecting grooves 57 by their own weight and sucking negative pressure. The shreds are ejected into the shred ejecting passage 58, preventing the above-mentioned drawbacks. The inclination of the shred ejecting groove 57 prevents the cigarettes C moving downward in a horizontal state from being caught by the cigarette ejecting groove 57, even if the width of the cigarette ejecting groove 57 is large.

Figure 8:
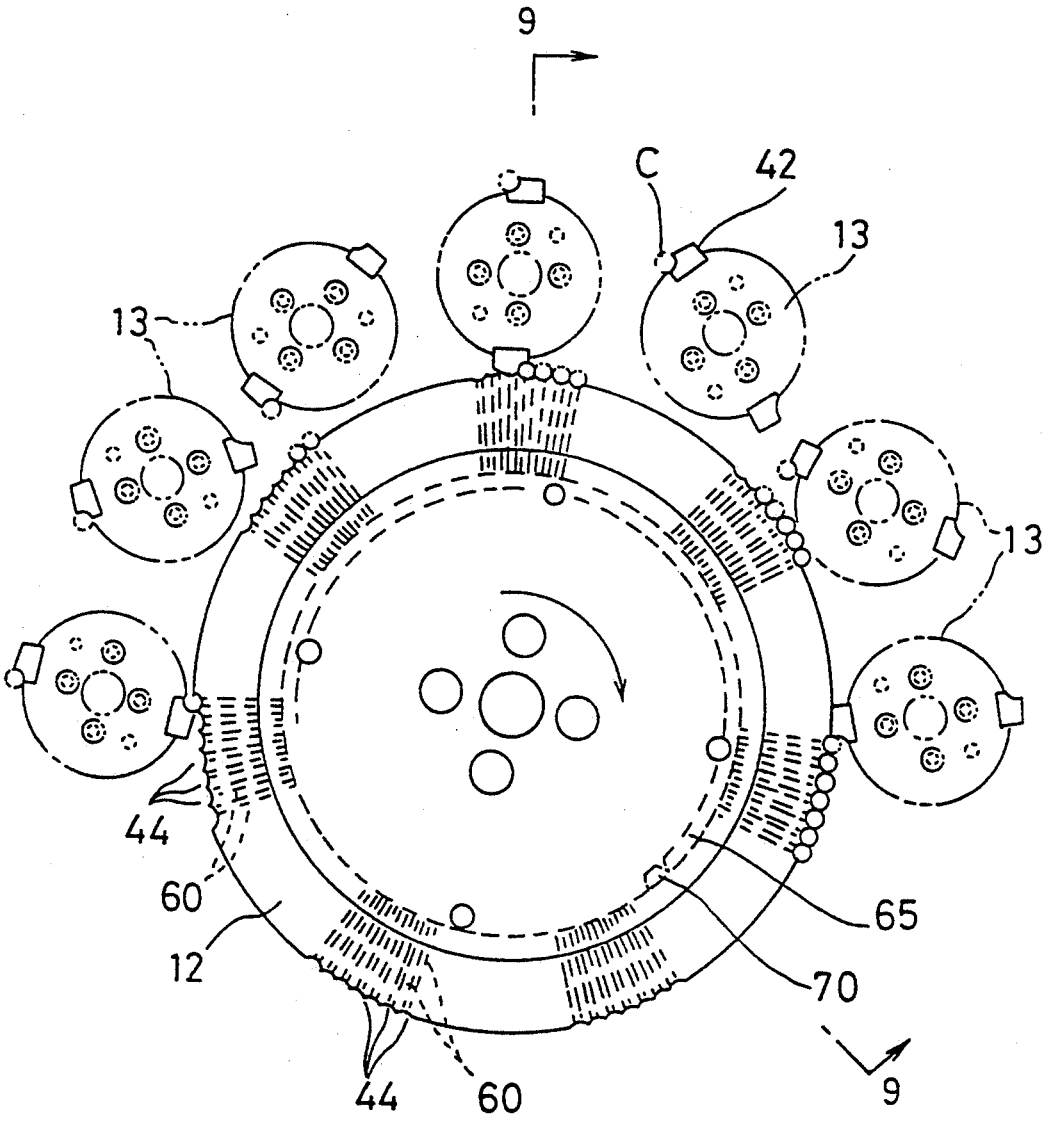
FIG. 8 is a front view of cigarette arranging drums.

The structure of the cigarette arranging drums 12 will be described with reference to FIGS. 8 to 10. As described above, each cigarette arranging drum 12 has a plurality of cigarette holding grooves 44 whose number is equal to the number of a cigarette layers of a cigarette stack to be formed later. A plurality of suction holes 60 extend radially through the cigarette arranging drum 12 and one end of each suction hole 60 opens at the corresponding cigarette holding groove 44. The cigarette arranging drum 12 is hollow cylindrical and the other end of each suction hole 60 opens at the inner peripheral surface of the cigarette arranging drum 12.

Figure 9:
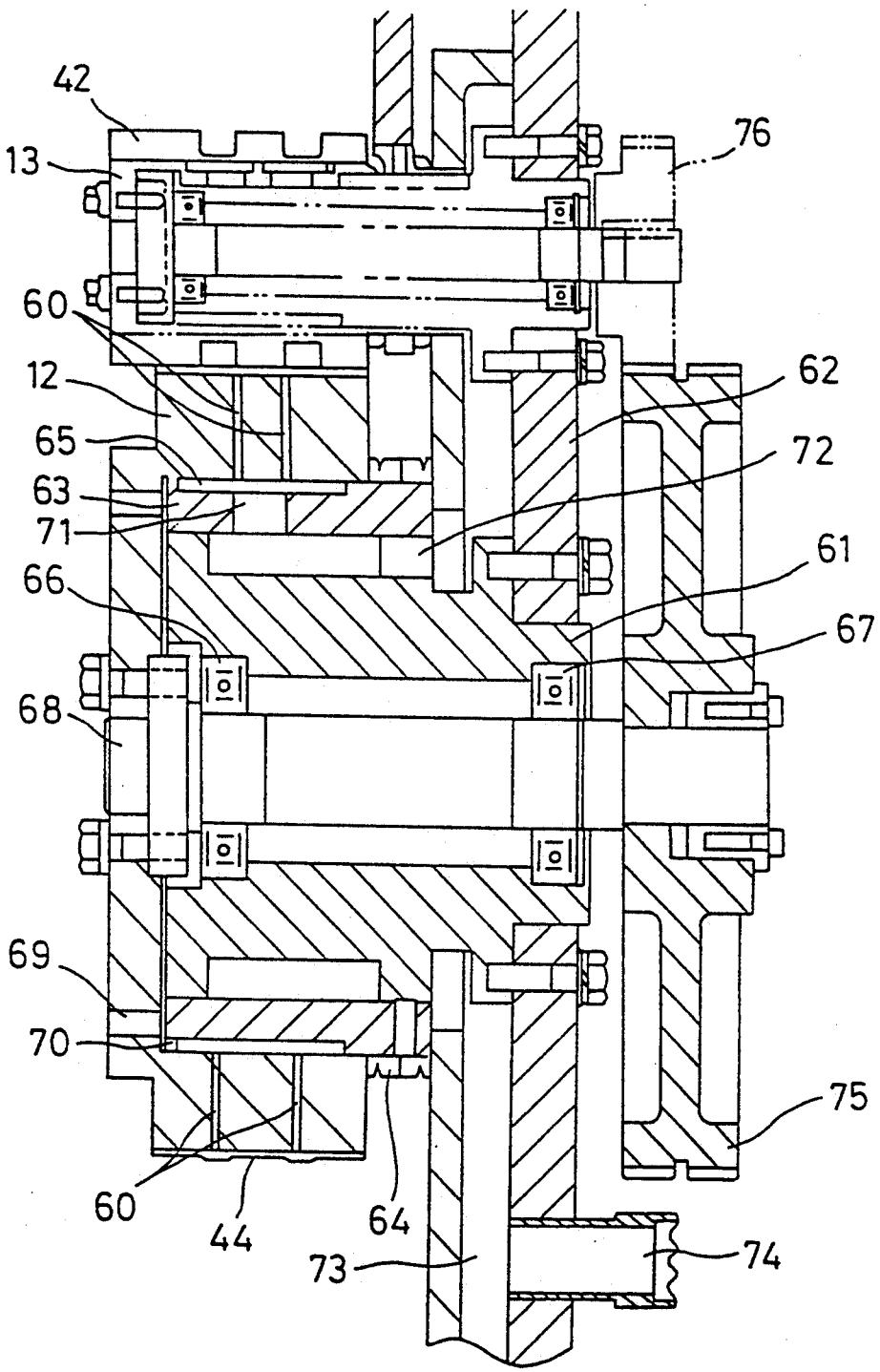
FIG. 9 is a cross-sectional view of line 9—9 of FIG. 8.

As shown in FIG. 9, a core member 61 is fixed to a plate member 62 at the fixed side of the apparatus. A cylindrical suction sleeve 63 is tightly mounted on the outer periphery of the core member 61 so that the members 61, 62 and 63 are not rotated. Through the center of the core member 61 extends a shaft 68 rotatably supported by bearings 66 and 67. The cigarette arranging drum 12 is fixed to the shaft 68 and is rotatable therewith. The inner peripheral surface of the cigarette arranging drum 12 is rotatably fitted on the inner peripheral surface of the suction sleeve 63 air-tightly. A V-ring 64 is used for maintaining this air-tightness.

In the outer peripheral surface of the suction sleeve 63 is formed a circumferentially extending suction groove 65 which is connected to a suction mechanism (not shown) via suction passages 71, 72, 73 and 74. When the suction hole 60 faces the suction groove 65 as the cigarette arranging drum 12 rotates, a negative pressure is produced in the suction hole 60 and sucks and holds the cigarettes C supplied from the cigarette receiving drum 13 to the cigarette holding grooves 44.

Figure 10:
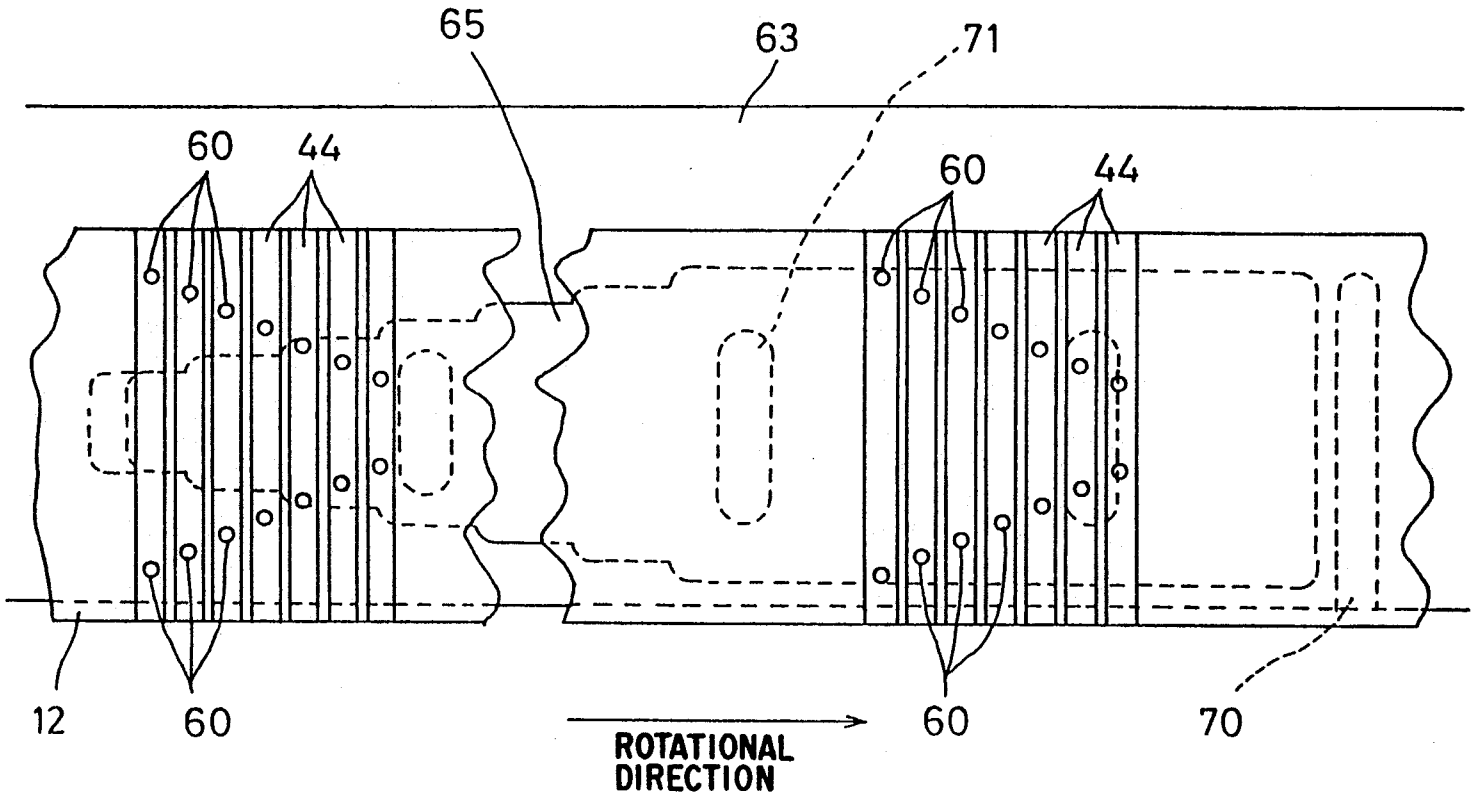
FIG. 10 is a developed view of a cigarette arranging drum along the circumference thereof.

FIG. 10 is a developed view of the cigarette arranging drum 12 and the suction sleeve 63 in a circumferential direction. As shown in this figure, an open groove 70 communicating with the outer atmosphere through a passage 69 is formed at the distal end portion of the suction 65 as viewed in the rotational direction of the cigarette arranging drum 12. When the cigarette holding groove 44 which sucks and holds a cigarette arrives at the open groove 70, the held cigarette is released from the negative pressure in the suction holes 60 and supplied to the transfer drum 15.

The cigarette arranging drum 12 and the cigarette receiving drum 13 are rotated through gears 75 and 76 in a synchronized relation.

As shown in FIG. 10, each cigarette holding groove 44 has two suction holes 60. The distance of the two suction holes 60 in the cigarette holding groove 44 nearest to the distal end of the developed suction groove 65 as viewed in the rotational direction of the cigarette arranging drum 12 is the smallest and the cigarette holding groove 44 nearest to the proximal end of the developed suction groove 65 is the largest. As the cigarette holding grooves 44 approach the proximal end of the developed suction groove 65, the distances between the suction holes 60 of the cigarette holding grooves 44 become gradually larger. The cigarette holding grooves 44 are referred to as the "first cigarette holding groove 44", the "second cigarette holding groove 44", the "third cigarette holding groove 44" and so on in the order from the distal end to the proximal end of the developed cigarette arranging drum 12, when such distinction is necessary for description. The proximal end portion of the suction groove 65 has the smallest width. As approaching the distal end, the width of the suction groove 65 is stepwise increased in accordance with the corresponding cigarette holding grooves 44. The stepped portions of the suction groove 65 are referred to as the "first portion", the "second portion", the "third portion" and so on in the order from the narrowest proximal end to the widest distal end of the suction groove 65.

There will now be described how cigarettes are received by each group of cigarette holding grooves 48. When cigarettes are transferred from the first cigarette receiving drum 13 to the first cigarette holding groove 44 which is the nearest to the distal end of the developed the cigarette arranging drum 12 in view of the rotational direction, the only two suction holes 60 in the first cigarette holding groove 48, the distance between which is the smallest, coincide with the narrowest proximal portion of the suction groove 65, a negative pressure is applied to the suction holes 16 of the first cigarette holding groove 44, and the transferred cigarettes are sucked and held in the first cigarette holding groove 44. The other cigarette holding grooves 44 do not coincide with the suction groove 65 and thus no negative pressure is applied to the suction holes 60 of the other cigarette holding grooves 44. When cigarettes are transferred from the second cigarette receiving drum 13 to the second cigarette holding groove 44, which is disposed next to the first cigarette holding groove 44 and the distance between the suction holes 66 of which is larger than the distance between the suction holes 60 of the first cigarette holding groove 44 but is smaller than the distance between the suction holes 60 of each of the other cigarette holding grooves 44, the only two suction holes 60 in the second cigarette holding groove 48 coincide the second portion of the suction groove 65, which second portion is wider than the first portion but is narrower than the other portions of the suction groove 65. A negative pressure is applied to the suction holes 16 of the second cigarette holding groove 44, and the transferred cigarettes are sucked and held in the second cigarette holding groove 44. The other cigarette holding grooves 44 do not coincide with the suction groove 65 and thus no negative pressure is applied to the suction holes 60 of the other cigarette holding grooves 44. The cigarette transfer from the third to sixth or seventh cigarette receiving drums 13 to the third to sixth or seventh holding grooves 44 are similarly carried out in succession.

The suction holes in the cigarette holding grooves to which cigarettes are being transferred communicate with the suction groove, while the suction holes in the cigarette holding grooves to which cigarettes are not transferred do not communicate with the suction groove. In this connection, a great amount of air is not sucked through the suction holes in the cigarette holding grooves in which cigarettes are not held and thus excessive loads are not applied to the suction mechanism. Further, a negative pressure in the suction groove 65 does not become weak and thus the sucking and holding force is prevented from being lowered.

As shown in FIG. 2, the transfer drums 15 are disposed between the cigarette arranging drums 12 and the cigarette piling drum 16. The transfer drum 15 has the same structure as the cigarette arranging drum 12 and is provided in the outer peripheral surface thereof with an odd number of groups of cigarette holding grooves, for example, three groups. Each group holds seven or six cigarettes which corresponds to the number of a cigarette layer of a cigarette stack to be formed. Each cigarette holding groove has suction holes similar to those of the holding groove of the cigarette arranging drum 12.

Each cigarette layer is transferred to the transfer drum 15 and sucked and held in the corresponding group of the cigarette holding grooves of the transfer drum 15. The cigarette layer held by each transfer drum are transferred to the cigarette piling drum 16.

Each transfer drum 15 is provided with an odd number of groups of cigarette holding grooves as described above. While a group of cigarette holding grooves face a cigarette arranging drum 12 and they are transferred from the cigarette arranging drum 12 to the respective group of cigarette holding grooves, the other groups of cigarettes holding grooves do not coincide with the cigarette piling drum 16 and the cigarettes are not transferred from the transfer drum 15 to the cigarette piling drum 16. Thus, the transfer of cigarettes from the cigarette arranging drum 12 to the transfer drum 15 and the transfer of cigarettes from the transfer drum 15 to the cigarette piling drum 16 are alternately performed. The rotational speeds of each drum 15 is intermittently changed by means of a cam mechanism or the like and the transfer drum 15 rotates at the same peripheral speed as the cigarette receiving drum 13 when cigarettes are transferred from the cigarette receiving drum 13 to the cigarette arranging drum 12 and the transfer drum 15 rotates at the same peripheral speed as the cigarette piling drum 16 when the cigarettes are transferred from the transfer drum 15 to the cigarette piling drum 16. It is accordingly unnecessary to render the peripheral speed of the cigarette arranging drum 12 equal to that of the cigarette piling drum 16, thereby facilitating the speed-up of the operation of the overall apparatus.

Provision of the transfer drums 15 can reduce the diameter of the cigarette piling drum 16. Specifically, it is necessary to arrange seven or six cigarette receiving drums 13, the number being the number of a cigarette layer of a cigarette stack, around each cigarette arranging drum 12. Cigarettes must be supplied by their own weight from the cigarette supplying passages to the cigarette receiving drums 13. It is preferred that each cigarette supplying passage 14 have a generally linear shape and extend vertically. It is necessary, therefore, to arrange the cigarette receiving drums 13 above each cigarette arranging drum 12. In order to satisfy these conditions, it is required that the diameter of and the distance between the cigarette arranging drum 13 be large to some extent if no means is provided. From the necessity of operation, the diameter of the cigarette piling drum 16 must be rendered large. When the above-mentioned transfer drums 15 are provided, however, the distance between the cigarette piling drum 16 and the cigarette arranging drums 12 is rendered larger by the distance corresponding to the diameter of the transfer drums 15. Therefore, although the diameter of the cigarette piling drum 16 is small, the diameter of and the distance between the cigarette arranging drums 12 can be made large enough.

Figure 11:
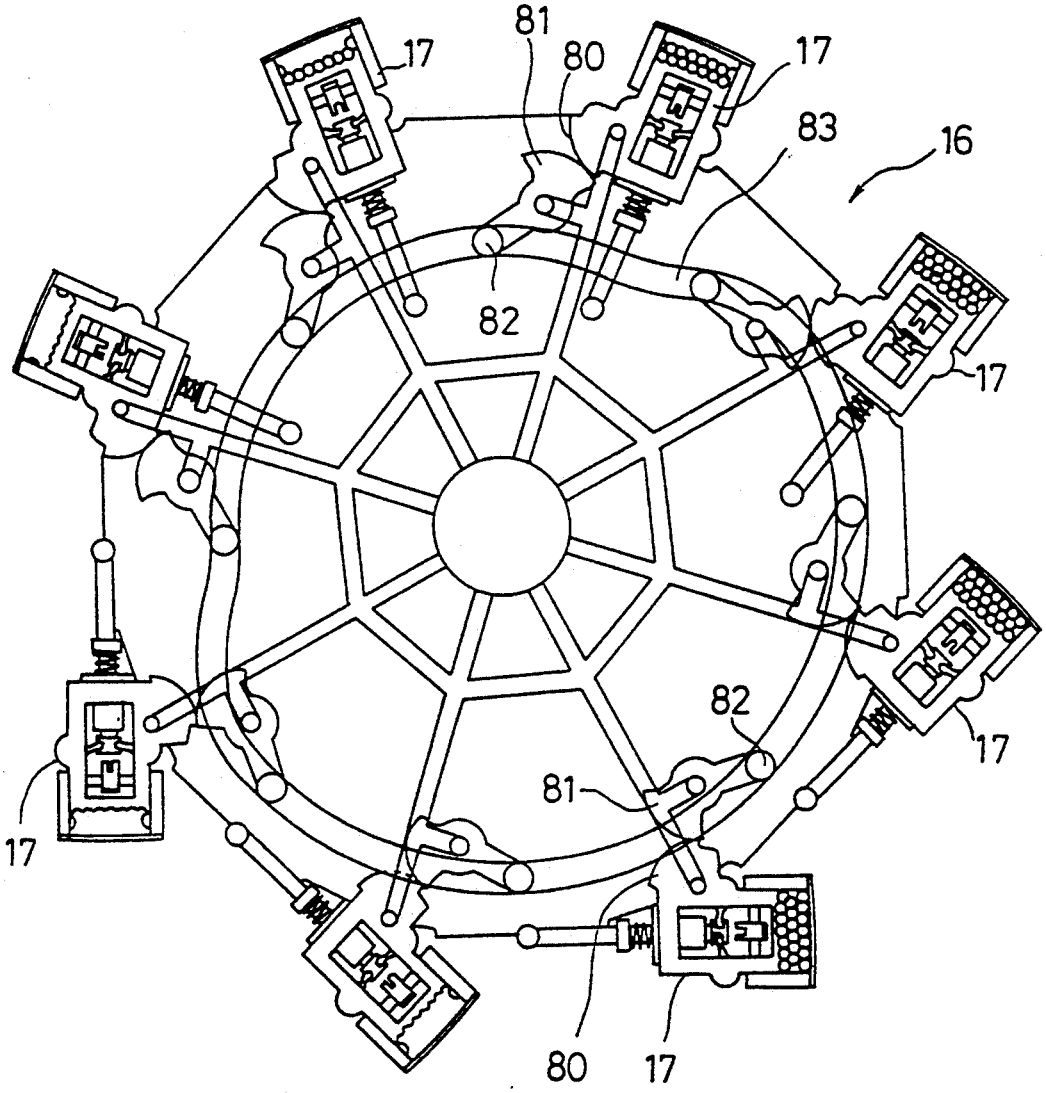
FIG. 11 is a front view of a cigarette piling drum.
Figure 12:
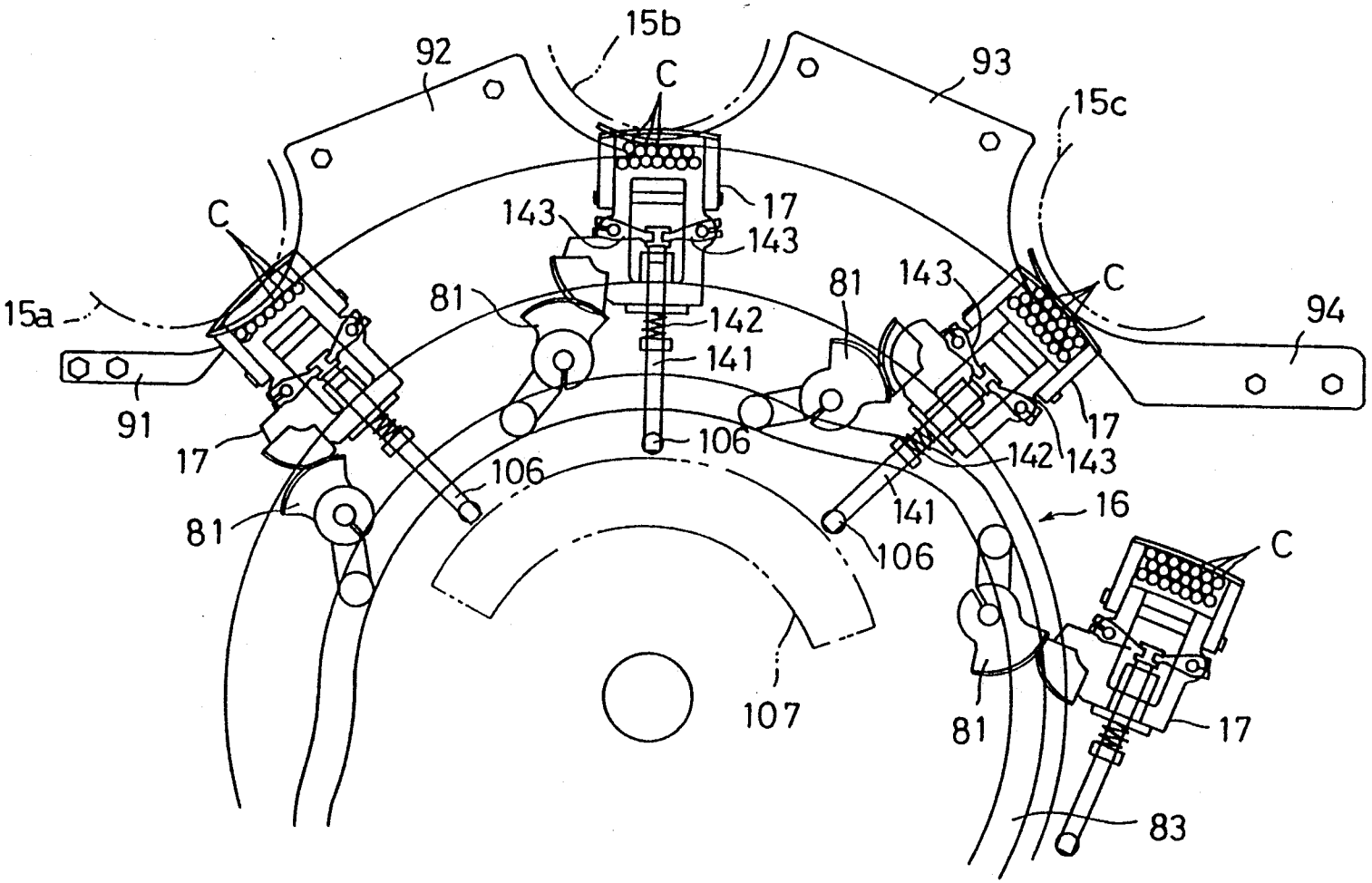
FIG. 12 is a front view of the cigarette piling drum and guide members.
Figure 13:
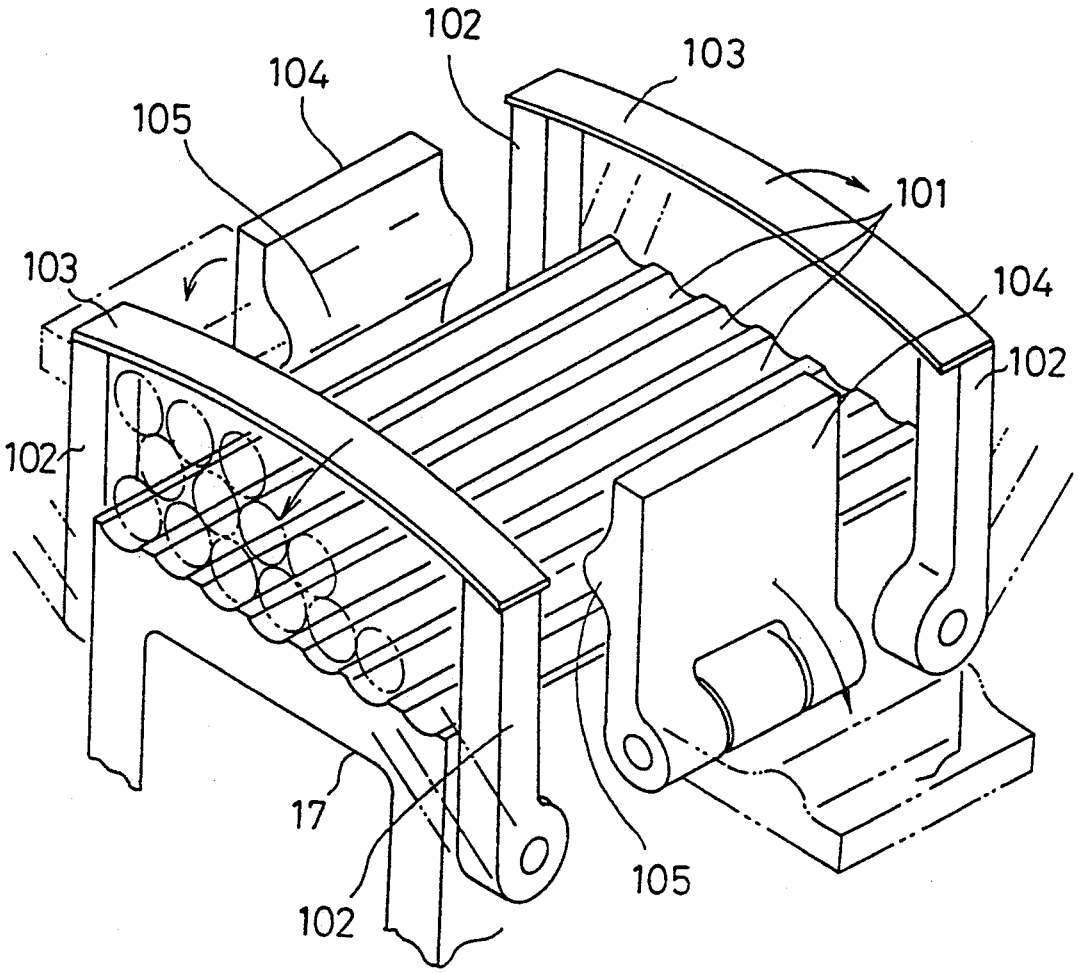
FIG. 13 is a perspective view of a cigarette piling head.

Referring to FIGS. 11 to 13, the structure of the cigarette piling head 16 will be described. As described above, the cigarette piling drum 16 is provided with a plurality of cigarette piling heads 17. A cigarette layer of a cigarette stack to be formed is transferred from a transfer drum 15 to the cigarette piling head 17. Three cigarette layers which will constitute a cigarette stack are piled on one after another in a staggered way. Thus, twenty cigarettes are piled and a cigarette stack corresponding to the number of cigarettes contained in a cigarette package is formed.

As shown in FIG. 3, the cigarettes piled on the cigarette piling heads 17 are transferred from the cigarette piling drum 16 to the intermediate drum 19 by the pushers 21 projecting from the pushing-out drum 18. As shown in FIG. 4, the heads 22 of the intermediate drum 19 swing according to the rotation of the intermediate drum 19 in order to transfer cigarettes from the intermediate drum 19 to the first packing drum **20*a* of the packing apparatus 2 and perform wrapping during the transfer. The cigarette piling heads of the cigarette piling drum 16 similarly swing synchronously with the swing of the heads 22 of the intermediate drum 19**.

In FIG. 11 is shown a mechanism for swinging the cigarette piling heads 17. Each cigarette piling head 17 is provided so as to be rotatable around an axis parallel to the axis of the cigarette piling drum 16. A sectorial gear portion 80 is formed on the cigarette piling head 17. Sectorial gears 81 engaging with the corresponding sectorial gear portions 80 of the cigarette piling heads 17 are provided on the cigarette piling drum 16. Each sectorial gear 82 has a cam flower 82 fitted in a peripheral cam 83 formed in the cigarette piling drum 16.

As the cigarette piling drum 16 rotates, the cam followers 82 are driven to rotate the cigarette piling heads 17 through the sectorial gears 81 and the sectorial portions 80. The peripheral cam 83 is shaped so that the cigarette piling heads 17 swing synchronously with the heads 22 of the intermediate drum 19. The postures of the cigarette piling heads 17 and the heads 22 of the intermediate drum 19 always correspond to each other. Therefore, the piled cigarettes can be securely transported, and the time interval between the commencement of advancement of the pushers 21 of the pushing-out drum 19 to the completion of the transfer of the cigarettes from the cigarette piling drum 17 to the heads 22 of the intermediate drum 19 can be prolonged to reduce the speed of the reciprocating movements of the pushers 21. By doing so, the speed of the apparatus can be enhanced with ease.

A mechanism for piling a cigarette layer in a cigarette piling head 17 from a transfer drum 15 will be described. Since several cigarette layers are piled in each cigarette piling head 17, these cigarettes cannot be sucked and held by a negative pressure against the centrifugal force if any other means is provided. The cigarettes are held by a mechanism shown in FIGS. 12 and 13. In FIG. 12, three transfer drums 15 are designated by 15*a*, 15*b* and 15*c* according to the rotational direction of the cigarette piling drum 16.

A first cigarette layer held on the first transfer drum 15*a* is released and transported to the cigarette piling head 17 under the guidance of guide members 91 and 92. The guide member 92 has an arcuated surface facing a cigarette piling drum 16. The radius of the arcuated surface is substantially equal to the radius of the locus of the movement of the first cigarette layer transferred to the cigarette piling head 17. In this way, the first cigarette layer C is held by the guide member 92 and prevented from being thrown away by the centrifugal forces.

When the cigarette piling head 17 is moved to the second transfer drum 15*b*, a second cigarette layer C passes the space between the trailing end of the guide member 92 and the leading end of the next guide member 93 and is transferred from the second transfer drum 15*b* to the cigarette piling head 17 to be piled on the first cigarette layer. The distance between the second transfer drum 15*b* and the cigarette piling drum 16 is larger by the height of a cigarette layer than the distance between the first transfer drum 15*a* and the cigarette piling drum 16 so that the second cigarette layer is smoothly piled on the second cigarette layer. The guide member 93 has an arcuated surface facing the cigarette piling drum 16. Since this arcuated surface has a radius substantially equal to the radius of the locus described by the movement of the second cigarette layer, the first and second cigarette layers are guided and held by the inner surface of the guide member 93.

As the cigarette piling head 17 is moved to the third transfer drum 15*c*, a third cigarette layer passes through the space between the trailing end of the guide member 93 and the leading end of the next guide member 94 and is transferred from the third transfer drum 15*c* to the cigarette piling head 17 to be piled on the second cigarette layer. The distance between the third transfer drum 15*c* and the cigarette piling drum 16 is larger by the height of a cigarette layer than the distance between the second transfer drum 15*b* and the cigarette piling drum 16 so that the third cigarette layer is smoothly piled on the second cigarette layer. The guide member 94 has an arcuated surface facing the cigarette piling drum 16. This arcuated surface has a radius substantially equal to the radius of the locus described by the movement of the third cigarette layer. Thus, the first to third cigarette layers are smoothly guided and held by the inner surface of the guide member 94.

As described above, the distances between the transfer drums 15*a*, 15*b* and 15*c* and the cigarette piling drum 16 are larger by the height of a cigarette layer than the distances between the just preceding transfer drums and the cigarette piling drum 16. This structure allows for smooth transfer of cigarette layers without using a mechanism for moving cigarette layers toward the central direction every time a cigarette layer is transferred.

As shown in FIG. 13, the cigarette piling drum 17 is provided with a holding mechanism for holding the piled cigarettes after the piling has been completed.

In the outer peripheral surface of the cigarette piling head 17 are formed seven cigarette holding grooves 101 corresponding to the number of the first cigarette layer. A pair of rotary arms 102 are provided on both sides of each end of the cigarette piling head 17. The tip ends of the paired rotary arms 102 on each end of the cigarette piling head 17 are interconnected by a holding plate 103. When the cigarette piling head 17 passes by the transfer drums 15*a*, 15*b* and 15*c* along the guide members 91, 92 and 93, the rotary arms 102 are rotated in the directions shown by arrows in FIG. 13 until they extend horizontally, whereby cigarettes can be easily transferred and these members are prevented from interfering with one after another. After three cigarette layers C have been transferred to the cigarette piling head 17, the rotary arms 102 are rotated reversely until they are returned to the positions shown in FIG. 13. Then, the holding plates 103 hold both ends of each cigarette in the third cigarette layer so that the holding plates 103 prevent the cigarettes from being thrown away due to a centrifugal force during the time when the cigarette piling head 17 swings according to the rotation of the head 22 of the intermediate drum 19 without changing its posture.

As shown in FIG. 13, the cigarette piling head 17 is provided on its both sides with a pair of cigarette-side holding arms 104. When the cigarettes are transported, the arms 104 are rotated in the directions shown by arrows in FIG. 13 until they extend generally horizontally as shown by two-dot chain lines so that they do not interfere with the cigarettes. After the first to third cigarette layers have been piled on the cigarette piling head 17, the arms 104 are rotated reversely until they are erected as shown by solid lines and hold both sides of the cigarette stack so that it surely keeps its shape. The cigarette stack consists of a lower layer of seven cigarettes, an intermediate layer of six cigarettes and a lower layer of seven cigarettes. The longitudinal central portions of the cigarette stack which corresponding to both ends of the intermediate cigarette layer are depressed by half a diameter of a cigarette. The portion of each cigarette-side holding arm 104 which correspond to the respective depression of the cigarette stack formed with a projection 105 which faces the respective projection 105. The projections 105 of both cigarette side holding arms 104 are fitted in the depressions of the cigarette stack to hold the piled cigarettes securely, thereby preventing the cigarette stack to lose its shape.

The rotary arms 102 and the cigarette side holding arms 104 are operated by cam mechanisms in response to the rotation of the cigarette piling drum 16. Referring to FIG. 12, the cam mechanism for operating the cigarette-side holding arms 104 will now be described. A square bar 141 projects from each cigarette piling head 17 radially inwardly of the cigarette piling drum 16 when the cigarette piling head 17 is oriented toward the center of the cigarette piling drum 16. A cam follower 106 is provided on the tip of the square bar 141. In the fixed side portion of the base of this apparatus is formed a cam 107 so as to correspond to the transfer drums and the guides. When the cigarette piling head 17 passes the regions of the transfer drums and the guides, the cam follower 106 engages the cam 107 and is raised. Levers 143 provided in the cigarette piling head 17 are rotated to cause the cigarette side holding arm 104 to be rotated at the above-mentioned timing. The square bar 106 is pressed against the cam 107 by a spring 142 and is restored to its free position by the spring 142 when the square bar 106 is disengaged from the cam 107.

The cam mechanism for operating the rotary arms 102 will now be described. Another cam is disposed axially adjacent to the cam 107. This cam mechanism has a similar structure to the ca mechanism for operating the cigarette-side holding arms 104, the detailed description thereof being omitted.

The twenty cigarettes to be wrapped in a cigarette package are piled on and held by the corresponding cigarette piling head 17 and pushed out axially by the pusher 21 of the pushing-out drum 18 to be transferred to a head 22 of the corresponding intermediate drum 19. The pushing-out drum 18, the cigarette piling drum 16 and the intermediate drum 19 are arranged coaxially with each other and provided with the cam mechanisms for operating the pushers 21, the heads 17 and 22, etc. These drums rotate synchronously with each other, while the cams are fixed to the members of a fixed portion of the apparatus. Thus, it is not easy to arrange the drums and cams if no other means is provided. The improvement of he arrangement of these elements and the structure of the pushing-out drum will now be described with reference to FIGS. 14 to 16.

Figure 16:
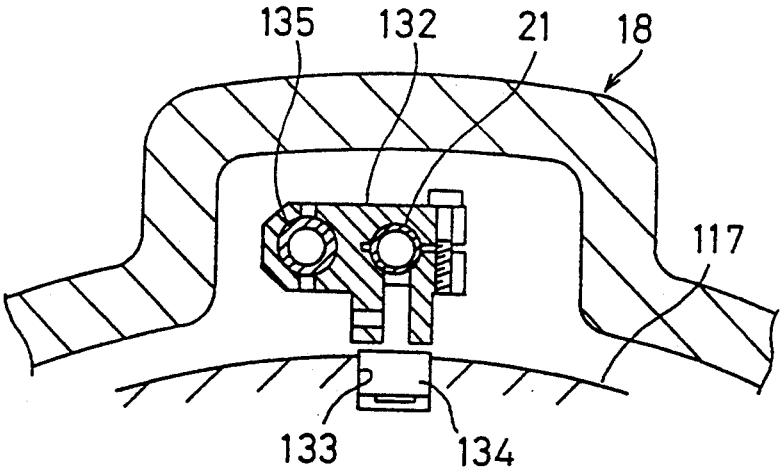
FIG. 16 is a cross-sectional view along line 16—16 of FIG. 15.

First, the pushing-out drum 18 will now be described. The drum 18 comprises a cylindrical box so that lubricant does not flow out of it. A cam 117 fixed to a member of a fixed portion of the apparatus is housed in the drum 18. A plurality of pushers 21 are axially slidably extend through the outer peripheral portion of the drum 18 and align with the corresponding cigarette piling heads 17 of the cigarette piling drum 16. Each pusher 21 is provided with a driven member 132 having a driven roller 134 fitted in a cam groove 133 formed in the cam 117. As the pushing-out drum 18 rotates, the pushers 21 project to transfer the piled cigarettes in the cigarette piling heads 17 of the cigarette piling drum 16 to the heads 22 of the intermediate drum 19. As shown in FIG. 16, a guide rod 135 is provided in parallel to each pusher 21. The driven member 132 is mounted on the guide rod 135 so as to be slidable therealong but cannot be rotated therearound.

Referring back to FIG. 14, the peripheral cam 23 for swinging the heads 22 of the intermediate drum 19 and a cam 111 for operating fingers 25 and the pushers 26 of these heads are provided at one side of the intermediate drum 19.

Figure 14:
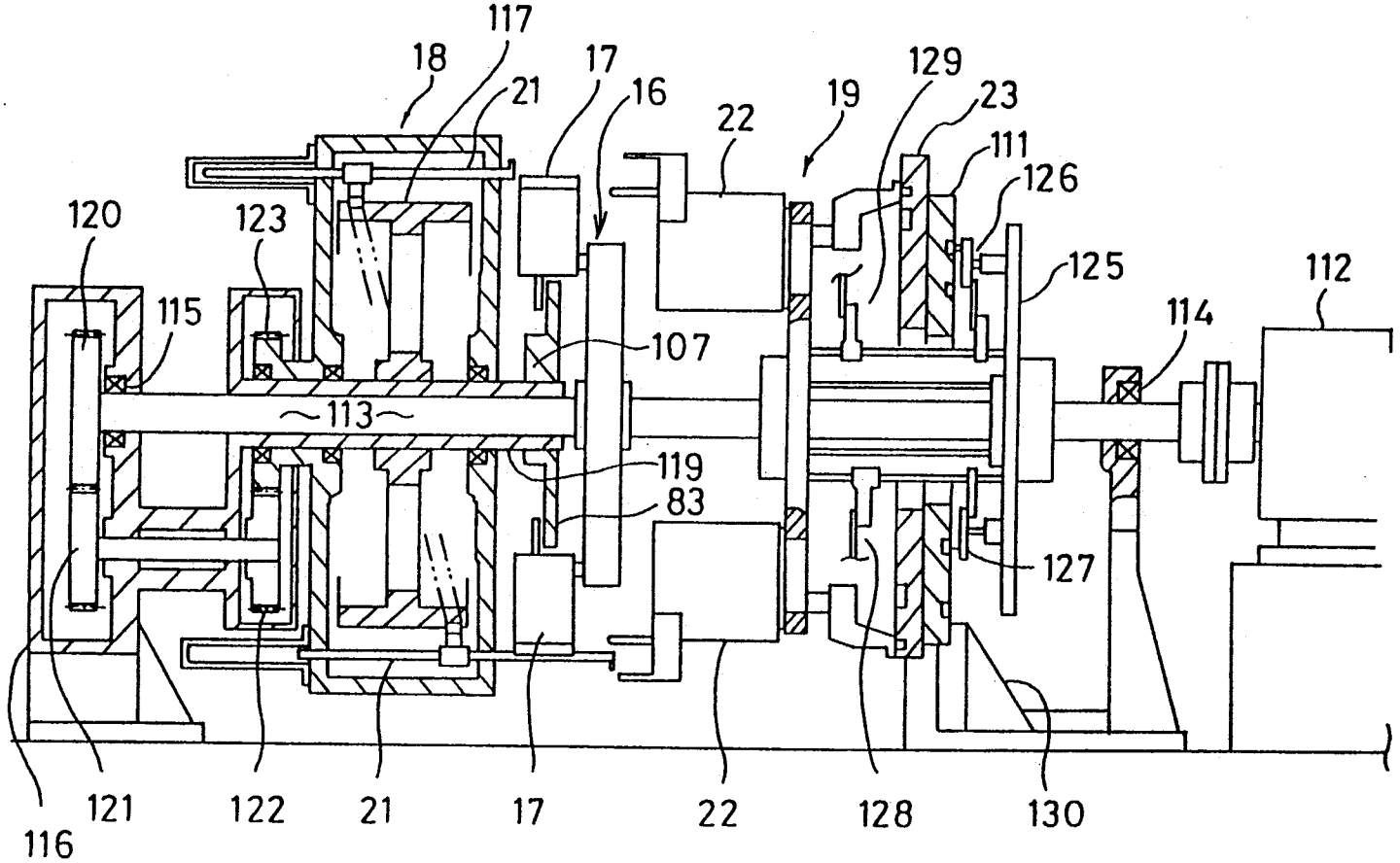
FIG. 14 is a side view of the cigarette piling apparatus.
Figure 15:
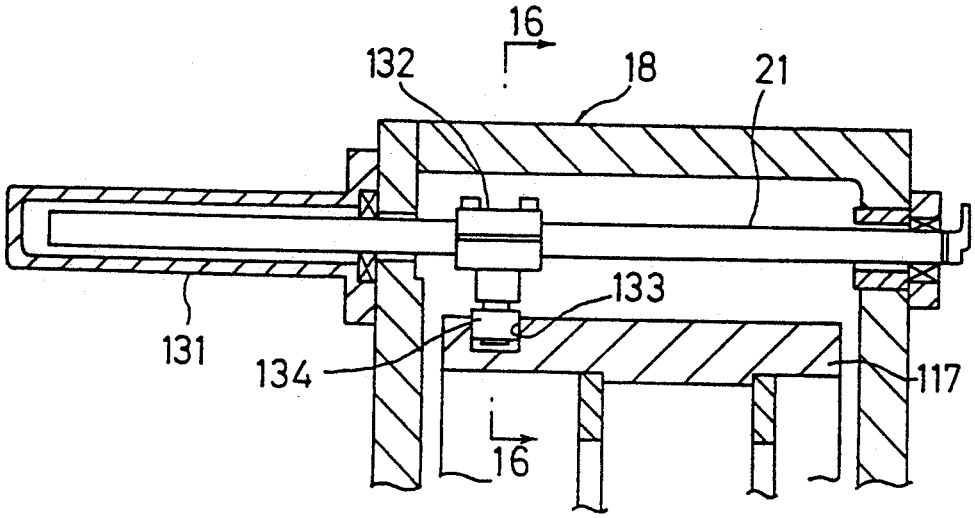
FIG. 15 is a longitudinal cross-sectional view of part of a pushing-out drum.

The drums and the cams are arranged as shown in FIG. 14. A driving shaft 113 driven by a driving device 112 extends through the central portions of the intermediate drum 19, the cigarette piling drum 16 and the pushing-out drum 18 and is supported at its proximal end portion by a bearing 114 and at the distal end portion by a bearing 115 provided in a gear box 116.

Toward the cigarette piling drum 16 from the gear box 116 extends a cylindrical supporting sleeve 119 in a cantilevered state. The driving shaft 113 extends through the supporting sleeve 113 so as to be rotatable. The pushing-out drum 18 are rotatably supported on an intemperate portion of the supporting sleeve 119 by means of bearings and is connected to the distal end of the driving shaft 113 through a gear 123 provided on the pushing-out drum 18 and gears 122, 121 and 120. The gear ratio of the gear train consisting of the gears 123, 122, 121 and 120 is 1 (unity) and thus the pushing-out drum 10 rotates at the same speed as the driving shaft 113.

The cigarette pile drum 16 is also connected to an intermediate portion of the driving shaft 113 and is rotated at the same speed of the shaft 113. The cams 83 and 107 which drive the related parts of the cigarette piling head 117 of the cigarette piling drum 16 is fixed to the distal end of the supporting sleeve 119 disposed at the fixed side of the apparatus. It is unnecessary to support the cams by means supporting members provided outside of these cams and therefore the parts of these cams do not interfere with the cigarette piling heads 17, the pushers 21, etc.

The intermediate drum 19 is also fixed to an intermediate portion of the driving shaft 113 and is rotated at the same speed of the driving shaft 113. At the side of the driving device 112 with respect to the intermediate drum 19 are provided the cams 23 and 111 supported by a supporting member 130 at the outer peripheral portions of the cams. Each of the cams 23 and 111 has an annular shape and the driving shaft 113 extend through the central portion of the cams 23 and 111. A rotary member 125 rotated together with the intermediate drum 19 is provided at the side of the driving device 112 with respect to the cams 23 and 111. The rotary member 125 includes cam follower mechanisms 126 and 127 fitted in the can 111. The operation of the cam follower mechanisms 126 and 127 are respectively transmitted to the heads 22 of the intermediate drum 19 through transmitting mechanisms 128 and 129 extending through the central portions of the annular cams 23 and 111.

This invention is not limited to this embodiment but can be applied to various modifications as long as they are not departed from the scope of this invention. For example, the positions of the pushing-out drum and the intermediate drum can be interchanged and the intermediate drum can be rotatably supported by the supporting sleeve.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A packing apparatus comprising:

a plurality of packing drums arranged side by side in the order of the first packing drum to the last packing drum and operated synchronously with each other, each of said packing drums being provided with a number of packing heads each head carrying the number of cigarettes in a cigarette package, said packing heads at a point of transfer swinging synchronously with each other so that said packing heads of the adjacent packing drums face each other and the same number of cigarettes as said number of cigarettes in said cigarette package are transferred and packed between said adjacent packing drums when said heads of said adjacent packing drums pass regions of said adjacent packing drums which are the closest to each other;

a rotatable cigarette piling drum provided with a plurality of cigarette piling heads, on each of which said number of cigarettes are piled, said cigarette piling drum having one axial end and the other axial end;

an intermediate drum provided adjacent to and coaxially with said cigarette piling drum at said one axial end of said cigarette piling drum and at a side of said first packing drum, said intermediate drum being rotated synchronously with said cigarette piling drum, said intermediate drum having the same number of cigarette holding heads as the number of said cigarette piling heads, for holding said number of cigarettes in said one cigarette package;

a pushing-out drum provided adjacent to and coaxially with said other axial end of said cigarette piling drum and rotated synchronously with said cigarette piling drum, said pushing-out drum being provided with the same number of pushers as said number of said cigarette piling heads, for pushing said number of said cigarettes out of said cigarette piling heads and transferring said cigarettes to said intermediate drum;

means for swinging said cigarette holding heads of said intermediate drum synchronously with said packing heads of said first packing drum; and means for swinging said cigarette piling heads synchronously with said cigarette holding heads of said intermediate drum at least in regions of said cigarette piling drum and said intermediate drum which are closest to each other.

2. The apparatus according to claim 1, further comprising a pair of rotatable cigarette-holding arms provided on both sides of each of said cigarette piling heads, and means for rotating said arms so as to be separated from each other when said cigarettes are being piled on said each cigarette piling head and rotating said arms toward each other after said cigarettes have been piled on said each cigarette piling head.

3. The apparatus according to claim 2, wherein a first cigarette layer consisting of seven cigarettes, a second cigarette layer consisting of six cigarettes and a third cigarette layer consisting of seven cigarettes are piled on one after another in a staggered manner so as to form a cigarette stack consisting of twenty cigarettes, said cigarette stack having two sides each formed with a central axial depression defined by the cigarettes of said first, second and third cigarette layers of said cigarette stack at each side of said cigarette stack and aligned with said second layer, and each of said cigarette-side holding arms is provided with a projection engageable with one of said depressions of said cigarette package.

* * * * *